United States Patent [19]

Fukuda

[11] 3,950,148

[45] Apr. 13, 1976

[54] LAMINATED THREE-LAYER RESINOID WHEELS HAVING CORE LAYER OF REINFORCING MATERIAL AND METHOD FOR PRODUCING SAME

[76] Inventor: Heijiro Fukuda, No. 123, 3-chome, Umegaoka, Nagaokakyo, Kyoto, Japan

[22] Filed: Aug. 1, 1974

[21] Appl. No.: 493,814

[30] Foreign Application Priority Data

| | | |
|---|---|---|
| Oct. 9, 1973 | Japan | 48-113719 |
| Oct. 18, 1973 | Japan | 48-117081 |
| Mar. 18, 1974 | Japan | 49-31284 |

[52] U.S. Cl. ..... 51/297; 51/298 R

[51] Int. Cl.[2] ..... B24D 11/00

[58] Field of Search ..... 51/297, 298, 293

[56] References Cited

UNITED STATES PATENTS

| | | | |
|---|---|---|---|
| 2,656,654 | 10/1953 | Erickson | 51/297 |
| 3,116,986 | 1/1964 | Goepfert et al. | 51/298 |
| 3,529,945 | 9/1970 | Charvat | 51/298 |
| 3,547,608 | 12/1970 | Kitazawa | 51/298 |

*Primary Examiner*—Donald J. Arnold
*Attorney, Agent, or Firm*—Allison C. Collard

[57] ABSTRACT

Laminated three-layer resinoid wheels having a core layer of reinforcing material are continuously produced by placing into a die a resinoid abrasive composition and a sheet of reinforcing material having a binder previously deposited thereon, with the reinforcing sheet interposed between layers of the abrasive composition, molding the mass of layers into a block, heating the block by a high frequency heater, passing the heated block through multiple pairs of rolls to roll the block into a sheet, blanking out circular pieces from the rolled sheet and baking the circular pieces.

6 Claims, 2 Drawing Figures

LAMINATED THREE-LAYER RESINOID WHEELS HAVING CORE LAYER OF REINFORCING MATERIAL AND METHOD FOR PRODUCING SAME

BACKGROUND OF THE INVENTION

The present invention relates to laminated three-layer resinoid wheels having a core layer of reinforcing material for cutting hard metal materials and a method for producing the same.

Reinforced resinoid wheels are known which comprise a core layer of reinforcing material such as glass cloth, glass mat or glass fiber net and outer layers covering the opposite surfaces of the core layer. With the conventional method of production, however, it is difficult to position the core layer at the center of thickness of the abrasive wheel, with the result that the core layer is formed as deviated toward one side. Consequently, the abrasive wheel is brought out of balance during operation and is prone to distortion and cracking. To describe in detail, conventional three-layer resinoid wheels of the type described are produced by placing a kneaded resinoid abrasive composition into a die of a given shape, smoothing the surface of the composition with raking means to give a uniform thickness to the mass of the composition, placing a sheet of reinforcing material over the composition, superposing another raked layer of the abrasive composition over the reinforcing sheet and subjecting the mass of layers to compression molding. However, this method has the drawback that relatively coarse abrasive grains are caught by the raking means and brought to the surface, rendering the uncured abrasive material in the mold coarser in its front surface and finer in its rear surface to result in uneven grain size distribution. Furthermore, since the raked mass of the starting abrasive composition is subjected to compression molding by being pressed on one side, there arises a difference between the pressures acting on the upper and lower surfaces of the mass. Consequently, the grinding wheel obtained becomes uneven in hardness, inasmuch as the product has high hardness where many coarse abrasive grains are present but low hardness where smaller grains are predominant. When put to use, the grinding wheel wears away more markedly where it contains many fine abrasive grains than where coarse grains predominate, so that an uneven wear takes place. As a result, the grinding wheel not only fails to cut a work straight but is possibly broken. Moreover, if the abrasive composition is not fully raked, the resulting product will have a nonuniform thickness, consequently producing errors when cutting a hard metal material, and the product is broken when it is markedly irregular in thickness.

SUMMARY OF THE INVENTION

The object of this invention is to overcome the foregoing problems and to provide laminated three-layer resinoid wheels having a core layer of reinforcing material and a method for continuously producing the same.

The present invention is characterized by a method for producing a laminated three-layer resinoid wheel having a core layer of reinforcing material comprising the steps of preparing a resinoid abrasive composition, placing a specified amount of the composition into a die in the form of a layer, placing over the layer of the abrasive composition a sheet of reinforcing material having a binder previously deposited thereon, placing the same specified amount of the abrasive composition over the reinforcing sheet in the form of a layer to the same thickness as the first-mentioned layer, molding the three-layer mass in the die into a block, heating the block, rolling the heated block into a sheet, blanking out a circular piece from the rolled sheet and baking the circular sheet.

The present invention is further characterized by a laminated three-layer resinoid wheel comprising upper and lower covering layers of an abrasive composition rolled by rolling rolls into a sheet and a core layer of reinforcing material interposed between the covering layers centrally thereof.

The invention is further characterized by a laminated three-layer resinoid wheel wherein one of the covering layers is formed by one half of a sheet of the abrasive composition rolled by rolling rolls and forming the other covering layer, and the reinforcing core layer is interposed between the covering layers centrally thereof.

According to the method of this invention, blocks of layers of resinoid abrasive compositions having a core layer of reinforcing sheet are efficiently rolled into sheets to automatically and inexpensively produce large quantities of various laminated resinoid wheels which are tough, accurate in thickness, free of any distortion and excellent in quality. Since the block of layers of abrasive compositions having a reinforcing core layer is passed between multiple opposing pairs of rotating rolls in succession and is thereby rolled into a sheet, the block is subjected to equal pressures on its opposite surfaces. Consequently, the abrasive wheel obtained is uniform in thickness and free of any distortion.

With the laminated three-layer abrasive wheel obtained by the method of this invention and comprising a core layer of reinforcing material and layers of abrasive composition covering the opposite surfaces of the core layer, the reinforcing sheet is positioned precisely at the center of the thickness of the wheel, so that the entire wheel is uniform in thickness and operative in balance, free of any distortion and cracking, and is therefore very tough.

DESCRIPTION OF THE PREFERRED EMBODIMENTS

Figure 1:
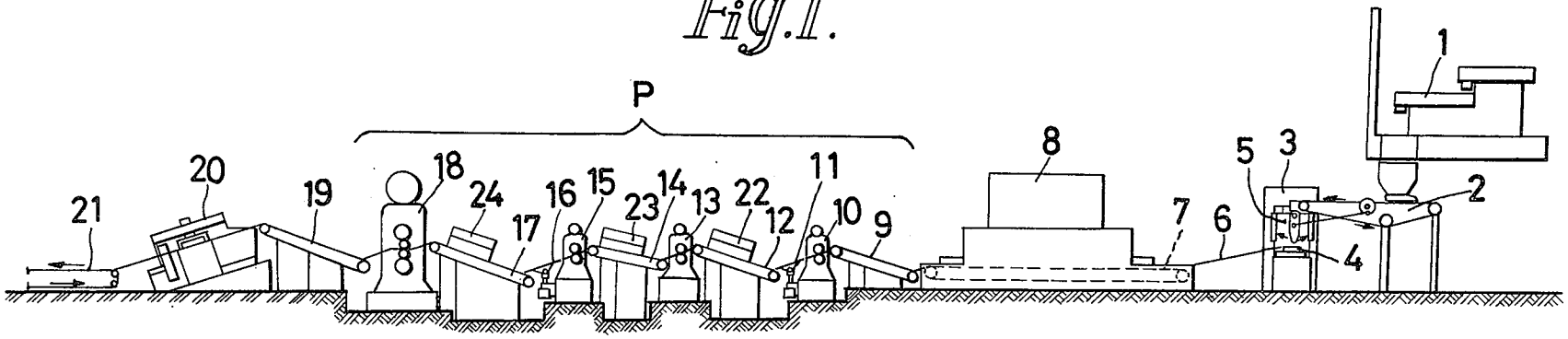
FIG. 1 is a schematic side elevation showing an embodiment of the overall apparatus for practicing the method of this invention.
Figure 2:
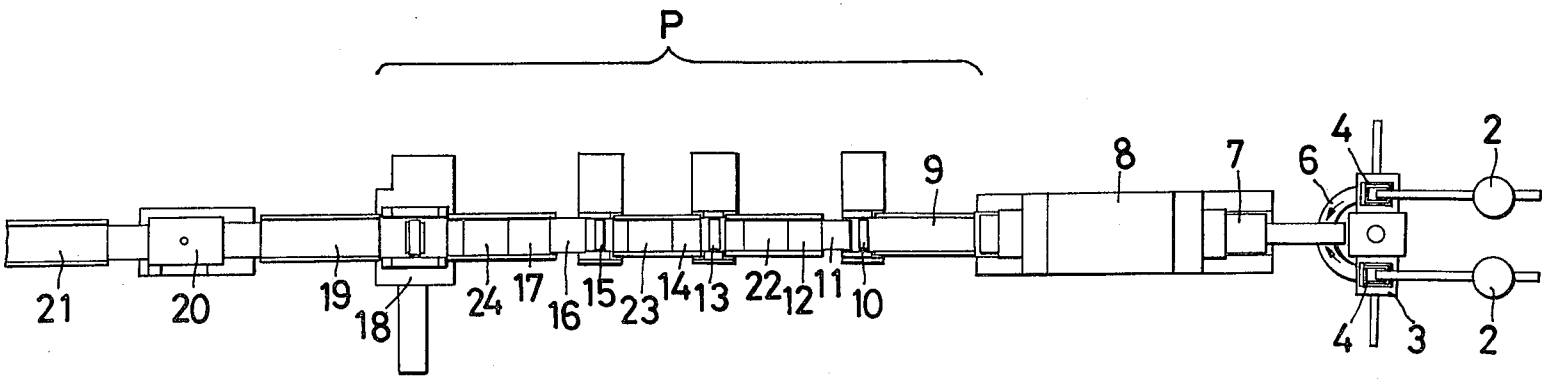
FIG. 2 is a schematic plan view showing the same.

With reference to FIGS. 1 and 2, 16- to 220-mesh abrasive grains of silicon carbide, alumina or siliceous sand, a binder such as phenolic resin, epoxy resin, diallyl phthalate resin or like thermosetting synthetic resin and, when desired, a filler such as creolite, iron disulfide, red iron oxide or clay are fed to a mixer 1 of the two-stage type in specified amounts respectively to prepare an abrasive composition. The composition is supplied to a feeder 2. The proportions by weight of the ingredients of the composition are 60 to 90 parts of abrasive grains, 10 to 20 parts of binder and 0 to 20 parts of filler. The abrasive composition is then fed by the feeder 2 to the lower die 4 of a block molding machine 3 in the form of a thin layer having an average thickness for example of 10 mm. Previously, a sheet of reinforcing material, such as glass mat, having a binder deposited thereon is prepared by immersing the net in a solution of binder and drying. Three or four sheets of the reinforcing material each having a thickness for example of 0.4 to 0.9 mm are placed to a thickness of 0.4 to 4.5 mm over the abrasive composition in the lower die 4. The same abrasive composition as above is then placed by the feeder 2 over the reinforcing sheets to the same thickness of 10 mm to form a three-layer mass. The layers in the lower die 4 are then lightly compressed by an upper die 5 positioned at the center upper portion of the block molding machine 3 to form a block of laminated abrasive composition. Usually the molding operation is conducted at a temperature of 70° to 90°C at a pressure of 80 to 140 kg/cm$^2$ for 20 to 60 seconds. The molded block is then transferred by a chute 6 onto a first conveyor 7, which passes the block through a high frequency heater 8 to heat the block for example at a temperature of 40° to 75°C for 15 to 25 seconds. A second conveyor 9 continuous with the first conveyor 7 feeds the heated block to first rolls 10. The rolled sheet obtained is then placed onto a first turntable 11, turned 90 degrees and sent by a third conveyor 12 to second rolls 13, whereby the rolled sheet shaped by the first rolls is rolled transversely. The resulting rolled sheet is thereafter carried on a fourth conveyor 14 to third rolls 15 and rolled. The sheet is further transferred onto a second turntable 16, turned 90° and then carried by a fifth conveyor 17 to a fourth unit of four high-precision rolls 18 which are vertically arranged in a row, whereby the abrasive sheet is eventually made into an uncured abrasive sheet 3.5 mm in thickness. Generally, the block of the abrasive composition has a thickness of 25 to 40 mm and is finally rolled to a sheet having a thickness of 1 to 15 mm. The sheet is then fed by a sixth conveyor 19 to a blanking press 20, by which circular pieces are blanked out from the sheet. In the present example, two to four raw circular abrasive pieces are blanked from one sheet. The circular pieces obtained are carried by a seventh conveyor 21 to a baking oven (not shown) and baked for a required period of time, whereby abrasive wheels for example 3.5 mm in thickness and 510 mm in diameter are obtained. More specifically, the uncured circular pieces are then placed between polished iron discs and baked in a tunnel type electric furnace or like device at a temperature suitable for the curing of the aforementioned synthetic resin used as the binder. For baking, the circular pieces are heated progressively from room temperature to 180°C over a period of about one day.

Preferably, the third, fourth and fifth conveyors 12, 14 and 17 are provided with infrared heaters 22, 23 and 24 for maintaining the uncured abrasive sheet at a predetermined temperature during transport. The second turntable 16 may be turned as when desired to spread the abrasive sheet widthwise for the production of large-sized abrasive wheels. Further as illustrated in FIG. 2, the block molding machine 3 preferably has two lower dies 4 for receiving and compressing the starting compositions alternately so that continuous operation can be carried out very smoothly. Such apparatus is disclosed for example in Japanese Utility Model application No. 128551/1972 already filed by the present applicant. To assure continuous operation, the blanking press 20 for uncured resinoid abrasive sheet may advantageously be of such construction that circular pieces can be blanked out from the sheet in timed relation to the movement of the sheet. Such apparatus is disclosed for example in Japanese Pat. application No. 111785/1972 already filed by the present applicant.

The three-layer laminated resinoid wheel of this invention having the above sheet of reinforcing material can also be produced by the following method. An abrasive composition prepared by the mixer 1 is supplied to the feeder 2, which feeds the composition to the lower die 4 of the block molding machine 3 to an average thickness for example of 10 mm. The composition in the lower die 4 is then lightly compressed into a block by the upper die 5 provided in the center upper portion of the block molding machine 3. The compressed block in the form of a single layer is then heated by a high frequency heater 8 and passed through the rolling machine A of the multistage type up to the third rolls 15 just before the terminal unit of rolls. The uncured abrasive sheet thus rolled is subsequently transferred onto a table (not shown), on which a sheet of reinforcing material such as glass mat, 0.5 to 0.7 mm in thickness and having a binder previously deposited thereon, is placed over approximately one half of the upper surface of the abrasive sheet. The remainder of the abrasive sheet is thereafter folded over the reinforcing sheet, whereby a three-layer sheet is obtained. It is then rolled by the finishing rolls 18. By the method described, a laminated three-layer circular abrasive wheel is produced which measures for example 3.5 mm in thickness and 510 mm in diameter. This method is especially preferable since the core layer of reinforcing sheet is provided precisely in the middle of the wheel.

If rolls coated with rubber or some other material equivalent thereto such as elastic synthetic resin, coper, lead, soft zinc or like soft metal are employed for the terminal unit of rolls for rolling the block of abrasive composition, the uncured resinoid abrasive piece obtained can be made rough-surfaced on its opposite sides. When baked, the piece will make an improved resinoid wheel.

More specifically, the resinoid bonded grinding wheel thus produced has rough front and rear surfaces with the abrasive grains alone projecting therefrom and therefore exhibits a greatly improved cutting ability. In fact, such grinding wheel is capable of cutting steel pipes and like hard metal materials easily, rapidly and with reduced heat generation to produce a cut surface which is free of scorching, distortion and discoloration. The resulting cut-off metal piece is accordingly suitable for the subsequent treatment. In this case the apparatus may advantageously include five pairs of rolling rolls, with the terminal pair of rolls covered with rubber, and an additional high frequency heater disposed immediately before the terminal pair to prevent the rolled sheet from cooling and to render the sheet rough-surfaced on its front and rear sides.

What I claim is:

1. A method for the continuous production of a laminated three-layer resin-bonded abrasive wheel having a core layer of reinforcing material, comprising the steps of:

a. preparing a moldable resinous abrasive composition by admixing abrasive grains having a mesh size in the range of about 16 to 220 mesh, with an uncured thermosetting synthetic resin binder therefor, in the proportion of about 60 to 90 parts by weight of abrasive grains to about 10 to 20 parts by weight of said binder;

b. placing a specified amount of said abrasive composition into a die in the form of a thin layer;

c. placing over said layer a sheet of a glass reinforcing material having said binder previously deposited thereon to form a reinforcing core to a total thickness between about 0.4 and 4.5 mm;

d. placing a specified amount of said resinous abrasive composition upon said reinforcing layer to form a three-layer mass;

e. molding said three-layer mass at a temperature of about 70° to 90°C at a pressure of about 80 to 140 kg/cm² for 20 to 60 seconds to form a molded block of laminated abrasive composition having a thickness of about 25 to 40 mm;

f. heating said molded block by high frequency wave energy heating at a temperature of about 40° to 75°C for about 15 to 25 seconds;

g. rolling said block by multiple rolling to a resin-binded laminated sheetblank having a thickness of 1 to 15 mm;

h. blanking out a circular piece from said sheet; and i. baking said circular piece at a temperature from room temperature to 180°C for a period of about 20 to 30 hours.

2. The method as set forth in claim 1 wherein the sheet of glass reinforcing material is selected from the group consisting of glass cloth, glass mat and glass fiber net and has a thickness of 0.4 to 0.9 mm, at least one reinforcing sheet being interposed between the abrasive layers in the form of a layer having a thickness of 0.4 to 4.5 mm.

3. The method as set forth in claim 1 wherein at least one filler selected from the group consisting of creolite, iron disulfide, red iron oxide and clay is further incorporated into the abrasive composition.

4. The method as set forth in claim 1 wherein the abrasive composition comprises 60 to 90 parts by weight of the abrasive grains, 10 to 20 parts by weight of the binder and 0 to 20 parts by weight of the filler.

5. The method as set forth in claim 4 wherein the sheet of abrasive composition is eventually rough-surfaced on its front and rear surfaces by the terminal unit of rolls during the rolling step.

6. A laminated three-layer resin-bonded abrasive wheel made by the method of claim 1.

* * * * *